US012521642B2

(12) United States Patent
Kamiyama

(10) Patent No.: US 12,521,642 B2
(45) Date of Patent: Jan. 13, 2026

(54) MODEL TOY AND COOKING TOY

(71) Applicant: EPOCH COMPANY, LTD., Tokyo (JP)

(72) Inventor: Kei Kamiyama, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 166 days.

(21) Appl. No.: 18/383,997

(22) Filed: Oct. 26, 2023

(65) Prior Publication Data

US 2024/0139643 A1 May 2, 2024

(30) Foreign Application Priority Data

Oct. 27, 2022 (JP) ..... 2022-172179

(51) Int. Cl.
*A63H 33/30* (2006.01)
*A63H 3/52* (2022.01)

(52) U.S. Cl.
CPC ..... *A63H 33/3072* (2013.01); *A63H 3/52* (2013.01)

(58) Field of Classification Search
CPC ... A63H 33/3055; A63H 33/3072; A63H 3/52
USPC ..... 446/381
See application file for complete search history.

(56) References Cited

U.S. PATENT DOCUMENTS 3,831,314 A * 8/1974 Bass ..... A63H 33/3055 446/481
4,755,141 A * 7/1988 Nakai ..... A63H 33/00 273/DIG. 30
4,834,687 A * 5/1989 Elam ..... A63H 33/00 273/DIG. 30
2008/0096463 A1* 4/2008 Wojtkiewicz ..... A63H 33/3055 446/481
2012/0225605 A1* 9/2012 Fein ..... A63H 33/3055 446/481
2017/0197155 A1* 7/2017 Su ..... A63H 33/42

FOREIGN PATENT DOCUMENTS

JP 2018-164492 A 10/2018

* cited by examiner

*Primary Examiner* — Thomas M Sember
(74) *Attorney, Agent, or Firm* — Faegre Drinker Biddle & Reath LLP

(57) ABSTRACT

A model toy includes: a main body including a plate portion; a first figure body provided on the plate portion; and a second figure body provided on the plate portion so as to be arranged in a state where the second figure body is close to the first figure body along an arrangement direction in which the first figure body and the second figure body are arranged. The first figure body engages the plate portion immovably. The second figure body engages the plate portion movably to allow the second body to move in a direction in which the second figure body is separated from the first figure body along the arrangement direction.

6 Claims, 5 Drawing Sheets

MODEL TOY AND COOKING TOY

CROSS-REFERENCE TO RELATED APPLICATIONS

This application is based on and claims priority under 35 USC 119 from Japanese Patent Application No. 2022-172179 filed on Oct. 27, 2022, the contents of which are incorporated herein by reference.

TECHNICAL FIELD

The present disclosure relates to a model toy and a cooking toy.

BACKGROUND ART

In the related art, model toys imitating kitchenware have been provided. For example, JP2018-164492A discloses, as a toy set, an imitation oven in which an intermediate material obtained by mixing a base material and an expansion agent can be input. When the intermediate material produced as a dough of imitation bread is input in the imitation oven, the intermediate material rises with a thickness of about 1.2 times after 20 minutes. Then, a baked color is added by applying an oily agent to the imitation bread after drying, as disclosed.

SUMMARY OF INVENTION

In the above-described model toy disclosed in JP2018-164492A, however, a time is required to obtain the imitation bread from the input of the dough, and thus a pleasure imitating a state change before and after cooking cannot be simply enjoyed.

An object of the present disclosure is to provide a model toy and a cooking toy for simply enjoying a pleasure imitating a state change before and after cooking.

The present disclosure provides a model toy including: a main body including a plate portion; a first figure body provided on the plate portion; and a second figure body provided on the plate portion so as to be arranged in a state where the second figure body is close to the first figure body along an arrangement direction in which the first figure body and the second figure body are arranged, in which: the first figure body engages the plate portion immovably; and the second figure body engages the plate portion movably to allow the second body to move in a direction in which the second figure body is separated from the first figure body along the arrangement direction.

The present disclosure provides a cooking toy including: a main body including a plate portion; a first figure body provided on the plate portion and defining a part of a cooking object; a second figure body provided on the plate portion so as to be arranged in a state where the second figure body is close to the first figure body along an arrangement direction in which the first figure body and the second figure body are arranged, the second figure body defining a rest part of the cooking object to define a whole shape of the cooking object when the second figure body is continuous with the first figure body; and a third figure body imitating a shape of a cutter configured to cut the cooking object, in which: the first figure body engages the plate portion immovably; and the second figure body engages the plate portion movably to allow the second figure body to move in a direction in which the second figure body is separated from the first figure body along the arrangement direction when a side of the second figure body facing the first figure body is pressed by the third figure body.

According to the present disclosure, it is possible to provide a model toy and a cooking toy for simply enjoying a pleasure imitating a state change before and after cooking.

BRIEF DESCRIPTION OF DRAWINGS

The present disclosure will be described in detail based on the following without being limited thereto, wherein.

DESCRIPTION OF EMBODIMENTS

Figure 1:
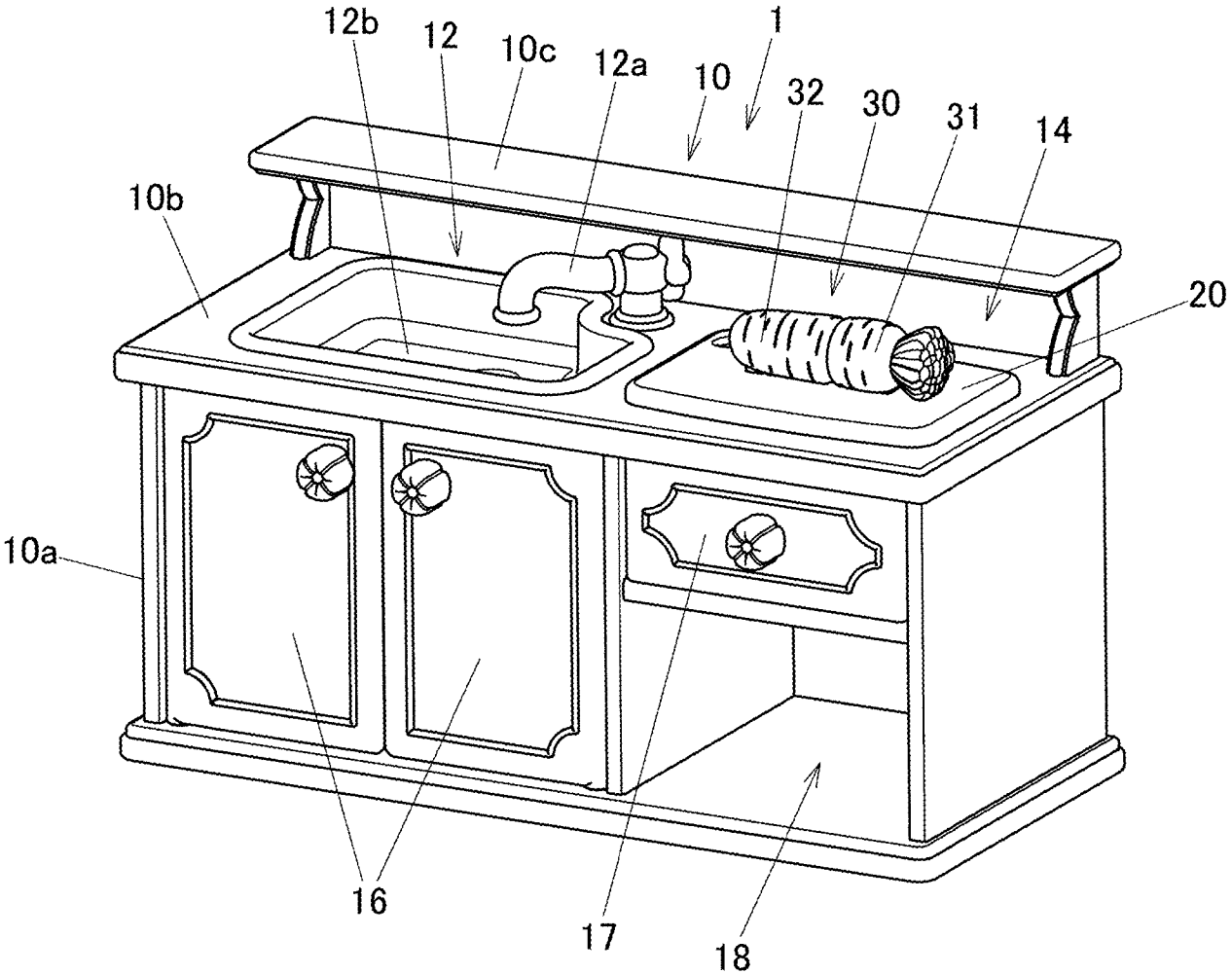
FIG. 1 is a perspective view illustrating an overall kitchen toy according to an embodiment of the present disclosure.

An embodiment of the present disclosure will be described with reference to the drawings. As illustrated in FIG. 1, according to the embodiment of the present disclosure, a kitchen toy (a model toy or a cooking toy) 1 imitating a kitchen will be described. The kitchen toy 1 is a toy with which meal time playing house can be done using a doll or the like. The kitchen toy 1 is formed in a substantially rectangular parallelepiped shape which is overall horizontally long and includes a main body 10 in which a sink stand 12 and a cooking table 14 are provided. A door 16 is provided below the sink stand 12. A drawer 17 and an accommodation space 18 are provided below the cooking table 14. Hereinafter, the door 16 side of the kitchen toy 1 is referred to as a front side and its opposite side is referred to as a rear side A drawer 17 side when the kitchen toy 1 is viewed from the front side is referred to as a right side and its opposite side is referred to as a left side for description.

Figure 2:
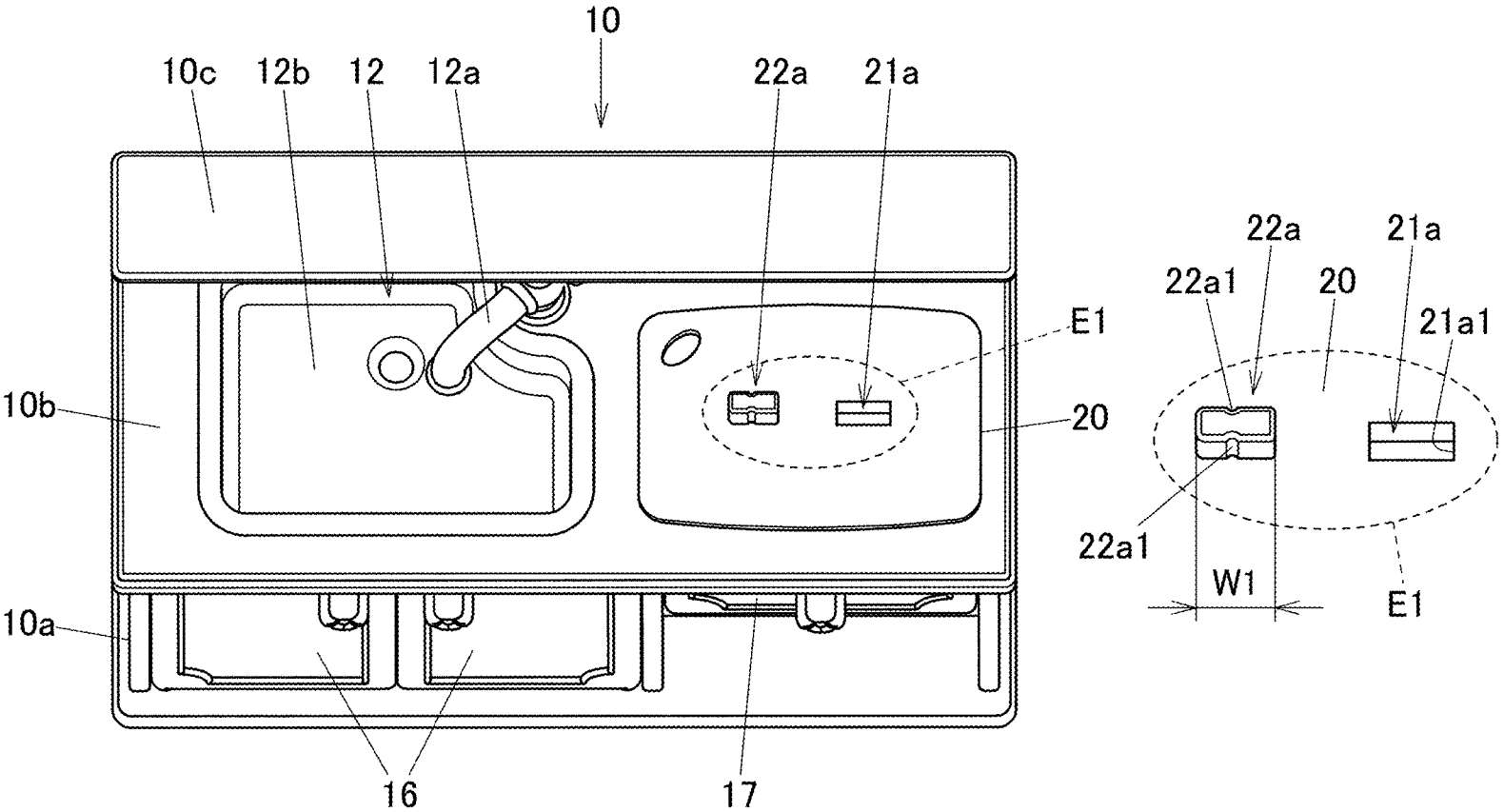
FIG. 2 is a perspective view illustrating the kitchen toy when viewed from the upper side according to the embodiment of the present disclosure.

As illustrated in FIG. 2, a chopping board (a plate portion) 20 with a slab shape is provided on the upper surface of the cooking table 14. A right-side carrot model (first figure body) 31 that is a figure body imitating a portion from a stem part to the middle of a trunk part of a carrot model (cooking object) 30 imitating a carrot and a left-side carrot model (second figure body) 32 that is a figure body imitating a portion from the middle of the trunk part to a tip part of the carrot model 30 are provided on the chopping board 20. The right-side carrot model 31 and the left-side carrot model 32 are arranged in parallel in the right and left directions on the chopping board 20 at a position at which portions imitating the middle of the trunk part of the carrot model 30 are close to each other such that the right-side carrot model 31 is on the right side and the left-side carrot model 32 is on the left side. Both the right-side carrot model 31 and the left-side carrot model 32 become close to each other and join to form the shape of the carrot model 30 as a whole.

In the kitchen toy 1, when a user puts down a kitchen knife model (third figure body) 40 (see FIGS. 4A and 4B) to a boundary B (see FIG. 3 or the like) between the right-side carrot model 31 and the left-side carrot model 32 from the upper side to the lower side in a state where the right-side carrot model 31 and the left-side carrot model 32 are close to each other, the left-side carrot model 32 moves to the left and a gap between the right-side carrot model 31 and the left-side carrot model 32 is opened. Accordingly, the user playing with the kitchen toy 1 feels a sense of cutting the carrot model 30 including the right-side carrot model 31 and the left-side carrot model 32 with the kitchen knife model 40. The kitchen toy 1 is a toy with which cooking can be enjoyed in an imitation manner as such. Hereinafter, a configuration of each member of the kitchen toy 1 will be described in detail.

As illustrated in FIGS. 1 and 2, the main body 10 is configured such that an external wall portion 10*a* forming the front surface, the rear surface, right and left side surfaces, and the lower surface, a top plate portion 10*b* forming the upper surface, and an upper wall portion 10*c* formed along the rear end edge of the upper surface are integrated. The inside of the external wall portion 10*a* is hollow. The door 16 provided on the front surface side of the external wall portion 10*a* is a hinged door which is a double wing door. A faucet 12*a* and a sink 12*b* are disposed in the sink stand 12 provided on the left side of the top plate portion 10*b*. At a location which is the inside of the main body 10 and is located on the lower side of the sink 12*b*, a distribution pipe (not illustrated) imitating a state communicating with a drain ditch portion of the sink 12*b* is provided on an inner surface side of a rear wall.

The chopping board 20 is a plate member that has a substantially rectangular shape horizontally long in the right and left directions when viewed from the upper side and four corners thereof are R-chamfered (round-chamfered). As illustrated in an enlarged drawing E1 in FIG. 2, a first engaging portion 21*a* depressed in a recessed shape to the lower side is provided on a portion of the chopping board 20 in which the right-side carrot model 31 is provided. In the first engaging portion 21*a*, an opening end 21*al* thereof has a substantially rectangular shape horizontally long in the right and left directions.

On the other hand, a second engaging portion (engaging portion) 22*a* protruding in a protruding shape to the upper side is provided on a portion of the chopping board 20 in which the left-side carrot model 32 is provided. The second engaging portion 22*a* protrudes in a substantially rectangular parallelepiped horizontally long in the right and left directions and four corners thereof are formed in an R shape. In the substantially middle portions in the right and left directions of both side surfaces facing in the front and rear directions in the second engaging portion 22*a*, each recess portion (recess) 22*al* recessed inwards in an arc shape is provided. Each recess portion 22*a*1 is provided in a shape extending in the upper and lower directions from the upper end to the lower end of the second engaging portion 22*a*.

Figure 3:
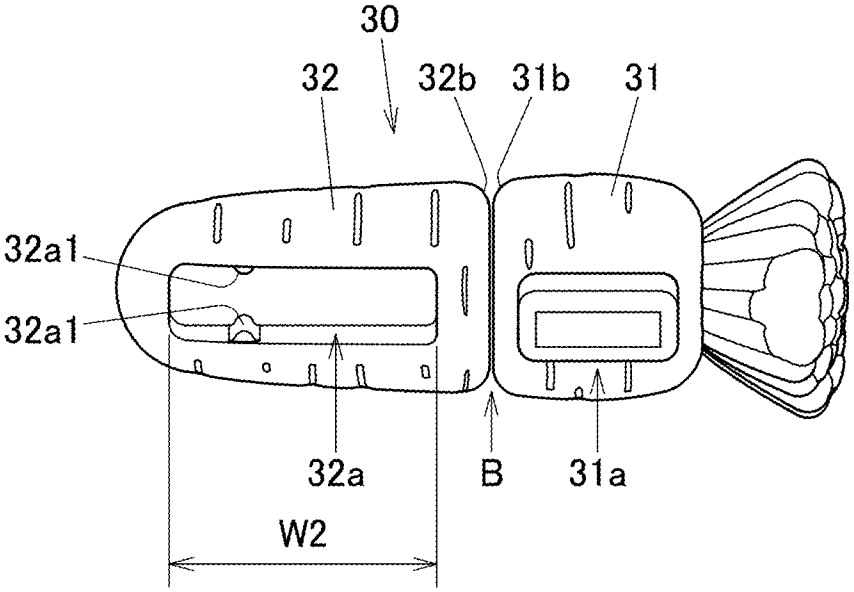
FIG. 3 is a perspective view illustrating a right-side carrot model and a left-side carrot model when viewed from the lower side.

Next, the carrot model 30 will be described with reference to FIG. 3. In FIG. 3, a lower side oriented to the chopping board 20 in the carrot model 30 is shown on the front side. A first engaged portion 31*a* protruding downwards in a protruding shape is provided on the lower side of the right-side carrot model 31 included in the carrot model 30. The first engaged portion 31*a* protrudes in a substantially rectangular parallelepiped horizontally long in the right and left directions and four corners thereof are formed in an R shape. The first engaged portion 31*a* has dimensions in the upper and lower directions, the right and left directions, and the front and rear directions so that the first engaged portion 31*a* fits into the first engaging portion 21*a* provided in the chopping board 20 with almost no clearance, and thus is fitted in the first engaging portion 21*a* by protrusion-recess fitting. The first engaged portion 31*a* is fixed to the first engaging portion 21*a* by an adhesive or the like in the protrusion-recess fitting state to be unmovable.

A second engaged portion (engaged portion) 32*a* depressed downwards in a recessed shape is provided on the lower side of the left-side carrot model 32 included in the carrot model 30. An opening end of the second engaged portion 32*a* is formed in a substantially rectangular shape horizontally long in the right and left directions. Dimensions of the second engaged portion 32*a* in the upper and lower directions and the front and rear directions substantially match the dimensions in the upper and lower directions and the front and rear directions of the second engaging portion 22*a* provided in the chopping board 20. On the other hand, a dimension W2 in the right and left directions of the second engaged portion 32*a* is greater than a dimension W1 in the right and left directions of the second engaging portion 22*a*. Therefore, the second engaged portion 32*a* in the protrusion-recess fitting state with the second engaging portion 22*a* is movable in the right and left directions within a range of the dimension W1 in the right and left directions.

Each protrusion (protrusion) 32*al* protruding outwards in an arc shape is provided in a portion left close to the front and rear inner surfaces of the second engaged portion 32*a*. Each protrusion 32*al* is provided in a shape extending in the upper and lower directions from the opening of the second engaged portion 32*a* along the bottom surface to correspond to the recess portion 22*al* of the second engaging portion 22*a*. The protrusion 32*al* is locked in the recess portion 22*al* with almost no clearance.

The right-side carrot model 31 and the left-side carrot model 32 are close in the right and left directions with a slight clearance in the boundary B between the models. An outer edge 31*b* on a side (left side) of the right-side carrot model 31 close to the left-side carrot model 32 and an outer edge 32*b* on a side (the right side) of the left-side carrot model 32 close to the right-side carrot model 31 are R-chamfered, respectively. In the embodiment of the present disclosure, the configuration in which the right-side carrot model 31 and the left-side carrot model 32 are close with a slight clearance has been exemplified. However, the "closeness" of the right-side carrot model 31 and the left-side carrot model 32 disclosed in the present specification also includes abutting of the right-side carrot model 31 and the left-side carrot model 32 with each other without any clearance.

Figure 4A:
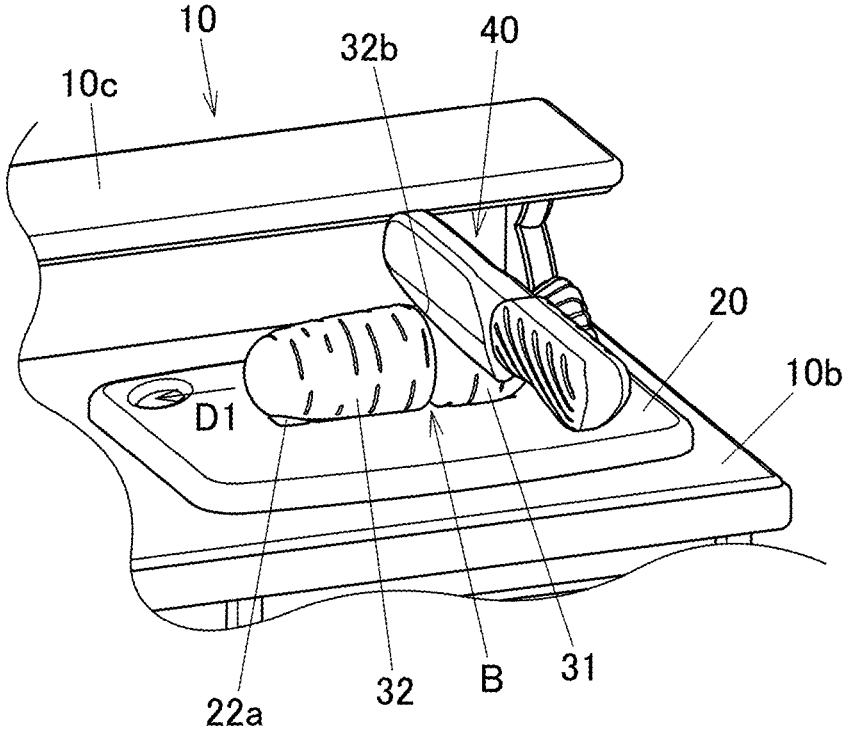
FIG. 4A is a perspective view illustrating the vicinity of a chopping board and a kitchen knife model in a state where the left-side carrot model is close to the right-side carrot model.
Figure 4B:
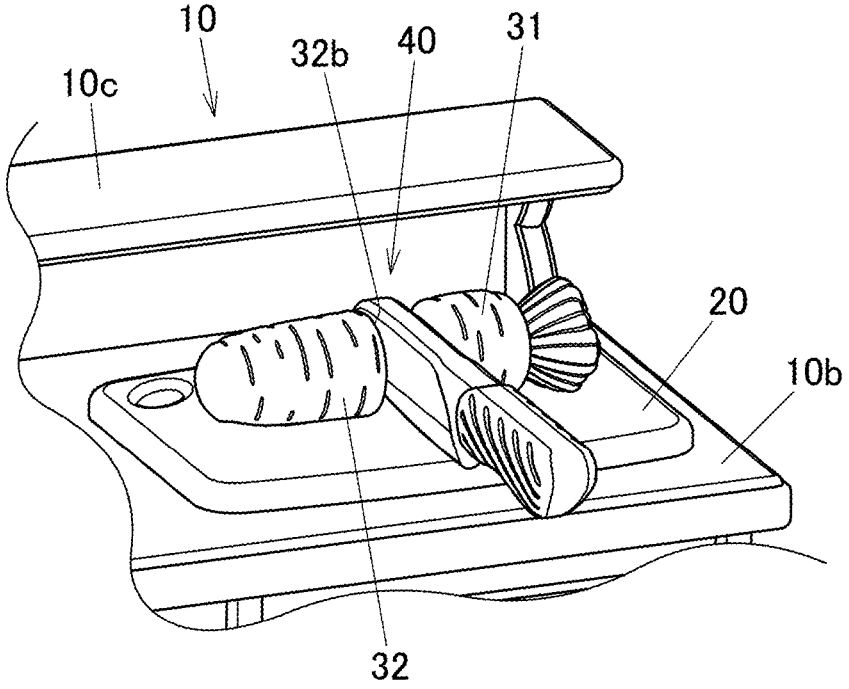
FIG. 4B is a perspective view illustrating the vicinity of the chopping board and the kitchen knife model in a state where the left-side carrot model is away from the right-side carrot model.
Figure 5A:
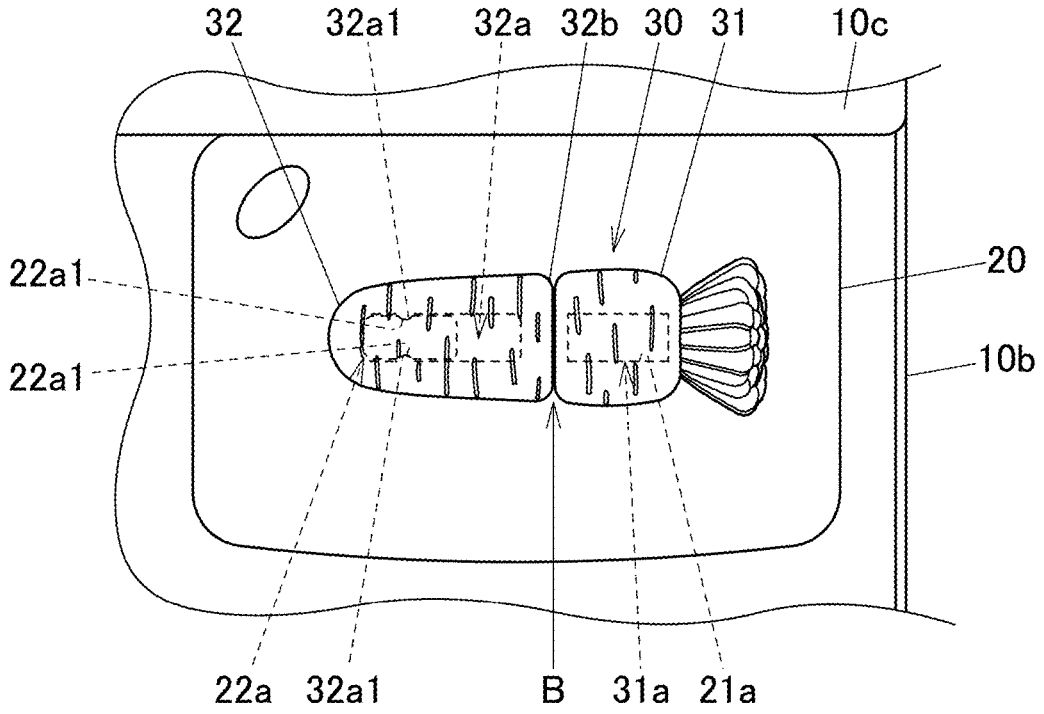
FIG. 5A is a top view illustrating the vicinity of the chopping board in the state where the left-side carrot model is close to the right-side carrot model.

Next, an operation mode of an operation in which the left-side carrot model 32 close to the right-side carrot model 31 is separated from the right-side carrot model 31 using the kitchen knife model 40 will be described with reference to FIGS. 4A to 5B. As illustrated in FIGS. 4A and 5A, in the state where the left-side carrot model 32 is closed to the right-side carrot model 31, that is, a state where the shape of the carrot model 30 is formed as a whole, the protrusion 32*al* of the left-side carrot model 32 is locked in the recess portion 22*al* of the second engaging portion 22*a*, and thus the second engaging portion 22*a* is located on the left end side in the second engaged portion 32*a* so that both the models are fitted.

Here, as illustrated in FIG. 4A, the user downwards puts down (presses down) the kitchen knife model 40 imitating the shape of a cutter by applying the kitchen knife model 40 to the boundary B of the carrot model 30 from above. Then, since the right-side carrot model 31 is fixed to the chopping board 20, the right outer edge 32*b* of the left-side carrot model 32 is pressed to the left by the kitchen knife model 40 and the protrusion 32*al* escapes from the recess portion 22*al*. Then, the left-side carrot model 32 is moved to the left (a D1 direction illustrated in FIG. 4A) along the second engaging portion 22*a*. Resistance occurs when the protrusion 32*al* escapes from the recess portion 22*al*. Therefore, the resistance can be sensed when the kitchen knife model 40 is put down.

Figure 5B:
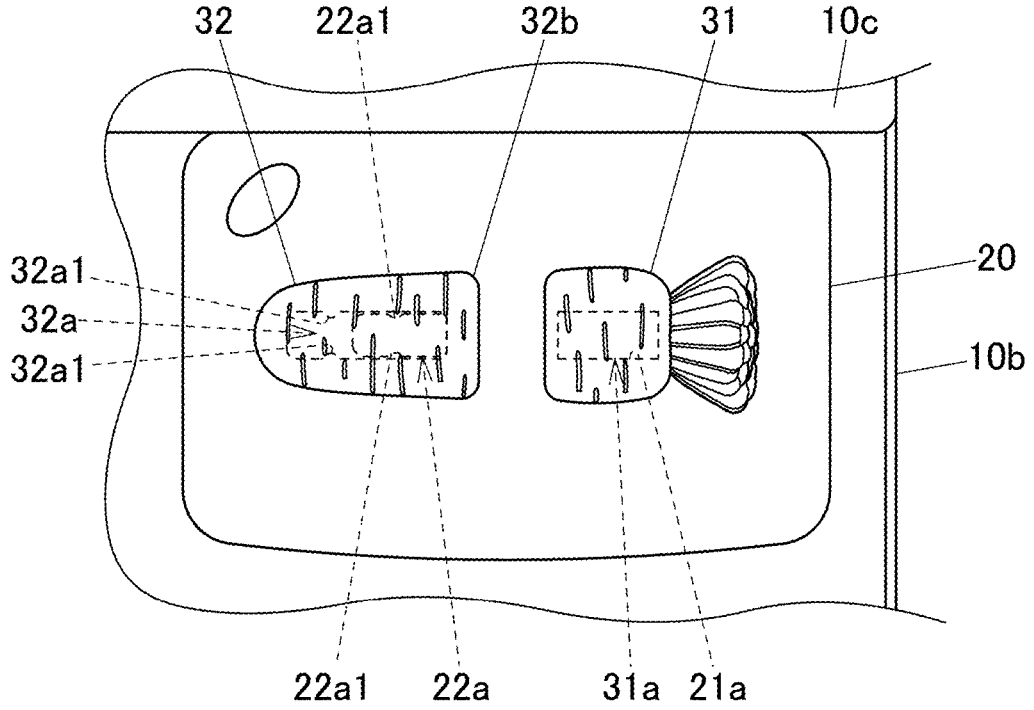
FIG. 5B is a top view illustrating the vicinity of the chopping board in the state where the left-side carrot model is away from the right-side carrot model.

When the left-side carrot model 32 is pressed by the kitchen knife model 40 and moved to the left, the second engaging portion 22*a* is located to the right end inside the second engaged portion 32*a* (a state where the left-side carrot model 32 is separated from the right-side carrot model 31, that is, the state illustrated in FIG. 5B). By moving the left-side carrot model 32 to the left, clearance is opened between the left-side carrot model 32 and the right-side carrot model 31 and the kitchen knife model 40 is put down on the chopping board 20, as illustrated in FIG. 4B. Here, since the right outer edge 32*b* of the left-side carrot model 32 is R-chamfered, the kitchen knife model 40 is smoothly guided downwards along the outer edge 32*b*.

As described above, in the kitchen toy 1 according to the embodiment of the present disclosure, by putting down the kitchen knife model 40 or the like to the boundary B of the carrot model 30 downwards from the upper side, the outer edge 32*b* of the left carrot model is pressed by the kitchen knife model 40 and the left-side carrot model 32 is moved to the left. Accordingly, the left-side carrot model 32 is separated from the right-side carrot model 31. Therefore, the user playing with the kitchen toy 1 can feel as if the user cut the carrot model 30 with the kitchen knife model 40, that is, as if the user cooked the carrot model 30, and thus can simply enjoy a play imitating a state change of the carrot model 30 before and after cooking.

According to the foregoing embodiment of the present disclosure, the model toy and the cooking toy according to the following aspects can be provided.

A model toy according to a first aspect includes: a main body including a plate portion; a first figure body provided on the plate portion; and a second figure body provided on the plate portion so as to be arranged in a state where the second figure body is close to the first figure body along an arrangement direction in which the first figure body and the second figure body are arranged. The first figure body engages the plate portion immovably, and the second figure body engages the plate portion movably to allow the second body to move in a direction in which the second figure body is separated from the first figure body along the arrangement direction.

In such configuration, when the outer edge of the second figure body facing the first figure body is pressed in the state where the second figure body is close to the first figure body, the second figure body is moved along the arrangement direction to be separated from the first figure body. For example, the first and second figure bodies are arranged in the arrangement direction and define the whole shape of a cooking object in the state in which the first and second figure bodies are close to each other. Then, when a user puts down a figure body imitating the shape of a cutter to the boundary of the first and second figure bodies downwards from the upper side in the state where the first and second figure bodies are close to each other, the outer edge of the second figure body is pressed by the cutter-like figure body, and thus the second figure body is separated from the first figure body. Therefore, the user can feel as if the user cuts the cooking object, and thus can simply enjoy a play imitating a state change before and after cooking.

In the model toy according a second aspect, the plate portion includes an engaging portion provided in a portion of the plate portion where the second figure body is provided, the second figure body includes an engaged portion that engages the engaging portion, one of the engaging portion and the engaged portion has a protruding shape, and the other of the engaging portion and the engaged portion has a recessed shape, and dimension of the engaged portion is greater than that of the engaging portion in the arrangement direction.

In such configuration, the engaged portion fitted in the engaging portion by the protrusion-recess fitting can be moved along the arrangement direction. Therefore, it is possible to implement a specific configuration in which the second figure body provided with the engaged portion can be moved along the arrangement direction.

In the model toy according a third aspect, a protrusion is provided in one of the engaging portion and the engaged portion, a recess corresponding to the protrusion is provided in the other of the engaging portion and the engaged portion, the protrusion is locked in the recess in the state where the second figure body is close to the first figure body, and the protrusion escapes from the recess in response to the second figure body being moved along the arrangement direction to be separated from the first figure body.

In such configuration, when the second figure body close to the first figure body is moved in the direction in which the second figure body is separated from the first figure body, the protrusion escapes from the recess. Accordingly, resistance occurs when the protrusion escapes from the recess by pressing the outer edge of the second figure body by the figure body or the like imitating the shape of the cutter, and the resistance creates an illusion of resistance received when a cooking object is cut. Therefore, the user can feel more realistically as if the user cuts the cooking object, and thus can simply enjoy a play imitating a state change before and after cooking.

In the model toy according a fourth aspect, the first figure body is shaped to define a part of a cooking object, and the second figure body is shaped to define a rest of the cooking object to define a whole shape of the cooking object in the state where the second figured body is close to the first figure body.

In such configuration, it is possible to implement a specific configuration of the first and second figure bodies for allowing the user to feel as if the user cuts the cooking object when the second figure body is separated from the first figure body.

A cooking toy according to the first aspect includes: a main body including a plate portion; a first figure body provided on the plate portion and defining a part of a cooking object; a second figure body provided on the plate portion so as to be arranged in a state where the second figure body is close to the first figure body along an arrangement direction in which the first figure body and the second figure body are arranged, the second figure body defining a rest part of the cooking object to define a whole shape of the cooking object when the second figure body is continuous with the first figure body; and a third figure body imitating a shape of a cutter configured to cut the cooking object. The first figure body engages the plate portion immovably. The second figure body engages the plate portion movably to allow the second figure body to move in a direction in which the second figure body is separated from the first figure body along the arrangement direction when a side of the second figure body facing the first figure body is pressed by the third figure body.

In such configuration, the outer edge of the second figure body facing the first figure body in the state where the second figure body is close to the first figure body is pressed by the third figure body, and the second figure body is moved along the arrangement direction to be separated from the first figure body. Therefore, when the user puts down the third figure body downwards to the boundary of the figure bodies in the state where the second figure body is close to the first figure body, that is, the state where the whole shape of the cooking object is formed, the second figure body is separated from the first figure body. Therefore, the user can feel as if the user cuts the cooking object with the third figure body, and thus can simply enjoy a play imitating a state change before and after cooking.

In the cooking toy according the second aspect, an outer edge of the second figure body facing the first figure body is round-chamfered.

In such configuration, when the user puts downs the third figure body downwards from the upper side to the boundary between the first and second figure bodies, the second figure body is pressed to the left by the third figure body along the round-chamfered portion and the third figure body is guided smoothly downwards. Therefore, an operation of separating the second figure body from the first figure body from the state where the second figure body is close to the first figure body can be performed smoothly, and thus the user can simply enjoy a play imitating a state change before and after cooking.

The embodiment of the present disclosure has been described, but the present disclosure is not limited to the foregoing embodiment and can be modified into various forms without departing from the scope of the present disclosure. For example, in the foregoing embodiment, a carrot model imitating a carrot has been exemplified as a figure body which is a cooking object, but the present disclosure is not limited thereto. Any of various figure bodies imitating food can be used. In the foregoing embodiment, the configuration in which the second engaging portion has a protruding shape and the second engaged portion has a recessed shape has been exemplified. But a configuration in which the second engaging portion has a recessed shape and the second engaged portion has a protruding shape may be implemented.

What is claimed is:

1. A model toy comprising:

a main body comprising a plate portion;

a first figure body provided on the plate portion; and a second figure body provided on the plate portion so as to be arranged in a state where the second figure body is close to the first figure body along an arrangement direction in which the first figure body and the second figure body are arranged, wherein the first figure body is provided on the plate portion at a side of the second figure body on the plate portion, wherein the first figure body engages the plate portion immovably, and wherein the second figure body engages the plate portion movably to allow the second body to move in a horizontal direction in which the second figure body is separated from the first figure body along the arrangement direction.

2. The model toy according to claim 1, wherein the plate portion comprises an engaging portion provided in a portion of the plate portion where the second figure body is provided, wherein the second figure body comprises an engaged portion that engages the engaging portion, wherein one of the engaging portion and the engaged portion has a protruding shape, and the other of the engaging portion and the engaged portion has a recessed shape, and wherein dimension of the engaged portion is greater than that of the engaging portion in the arrangement direction.

3. The model toy according to claim 2, wherein a protrusion is provided in one of the engaging portion and the engaged portion, wherein a recess corresponding to the protrusion is provided in the other of the engaging portion and the engaged portion, wherein the protrusion is locked in the recess in the state where the second figure body is close to the first figure body, and wherein the protrusion escapes from the recess in response to the second figure body being moved along the arrangement direction to be separated from the first figure body.

4. The model toy according to claim 1, wherein the first figure body is shaped to define a part of a cooking object, and wherein the second figure body is shaped to define a rest of the cooking object to define a whole shape of the cooking object in the state where the second figured body is close to the first figure body.

5. A cooking toy comprising:

a main body comprising a plate portion;

a first figure body provided on the plate portion and defining a part of a cooking object;

a second figure body provided on the plate portion so as to be arranged in a state where the second figure body is close to the first figure body along an arrangement direction in which the first figure body and the second figure body are arranged, the second figure body defining a rest part of the cooking object to define a whole shape of the cooking object when the second figure body is continuous with the first figure body; and a third figure body imitating a shape of a cutter configured to cut the cooking object, wherein the first figure body engages the plate portion immovably, and wherein the second figure body engages the plate portion movably to allow the second figure body to move in a direction in which the second figure body is separated from the first figure body along the arrangement direction when a side of the second figure body facing the first figure body is pressed by the third figure body.

6. The cooking toy according to claim 5, wherein an outer edge of the second figure body facing the first figure body is round-chamfered.

* * * * *